United States Patent [19]

Kling

[11] Patent Number: 4,960,138

[45] Date of Patent: Oct. 2, 1990

[54] FINGERNAIL PROTECTIVE DEVICE

[76] Inventor: Tamara L. Kling, 120 Michigan, Box 466, Hartford, Mich. 49057

[21] Appl. No.: 371,840

[22] Filed: Jun. 27, 1989

[51] Int. Cl.[5] ..... A45D 29/00

[52] U.S. Cl. ..... 132/73

[58] Field of Search ..... 132/73, 285

[56] References Cited

U.S. PATENT DOCUMENTS

| | | | |
|---|---|---|---|
| 1,135,382 | 4/1915 | Kindred | 132/73 |
| 1,942,332 | 1/1934 | Hamberg | 132/73 |
| 2,094,962 | 10/1937 | Raworth | 132/285 |
| 2,941,535 | 6/1960 | Lappe | 132/73 |
| 3,228,404 | 1/1966 | Turner | 132/73 |
| 3,487,831 | 1/1970 | Jaune et al. | 132/73 |
| 3,993,084 | 11/1976 | Cullen | 132/73 |
| 4,408,622 | 10/1983 | Meyerhoefer et al. | 132/73 |
| 4,554,935 | 11/1985 | Hokama | 132/73 |
| 4,577,648 | 3/1986 | Dinerstein et al. | 132/73 |
| 4,625,740 | 12/1986 | Roth | 132/73 |
| 4,694,843 | 9/1987 | Casenhiser | 132/73 |

FOREIGN PATENT DOCUMENTS

| | | | |
|---|---|---|---|
| 0637050 | 5/1950 | United Kingdom | 132/73 |

*Primary Examiner*—John J. Wilson
*Assistant Examiner*—Frank A. LaViola, Jr.
*Attorney, Agent, or Firm*—Leon Gilden

[57] ABSTRACT

A fingernail protective device is set forth for surrounding securement about a fingernail wherein the protective device includes a plurality of embodiments which includes an accommodating slot, apertures, a "V" shaped slot, as well as an overfolded member for protection of an associated fingernail.

1 Claim, 4 Drawing Sheets

Fig 9
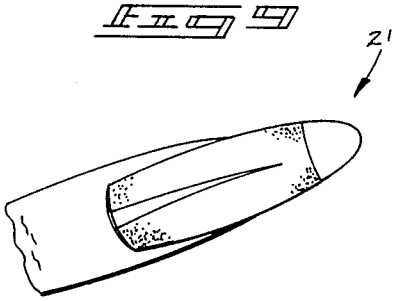
Fig 10
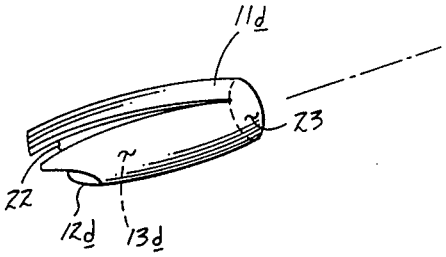
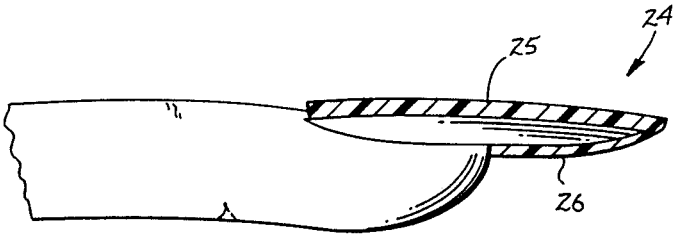
Fig 11

FINGERNAIL PROTECTIVE DEVICE

BACKGROUND OF THE INVENTION

1. Field of the Invention

The field of invention relates to fingernail devices, and more particularly pertains to a new and improved fingernail protective device wherein the same is arranged for surrounding engagement with a fingernail for protection thereof.

2. Description of the Prior Art

The use of various fingernail protective devices is well known in the prior art. To protect an associated fingernail from external forces and impacts that may contact and damage a nail, devices of the prior art have been utilized for overlying engagement with a fingernail. For example, U.S. Pat. No. 3,228,404 sets forth a fingernail protective device wherein a cement is formed about a fingernail with a cellulose layer secured to the cement prior to the cement completely curing for protection of the fingernail.

U.S. Pat. No. 3,487,831 for Jaume sets forth an artificial fingernail formed of a generally elongate configuration and securable to the nail for protection thereof by use of a glue or the like.

U.S. Pat. No. 4,408,622 to Meyerhoefer sets forth a fingernail extension formed with a wedge-shaped pocket at its rearward end for reception of the natural fingernail therewithin with bonding of the natural fingernail to the extension, as desired.

U.S. Pat. No. 4,577,648 to Dinerstein provides a shield with slots therethrough from which a natural nail may project to enable coating of the natural nail with a protective solution.

U.S. Pat. No. 4,625,740 to Roth sets forth an artificial nail tip securable to a natural nail utilizing a flexible convex plastic sheet with a stepped shoulder for reception of a leading edge of the natural nail with adherence of the natural nail to the artificial extension.

As such, it may be appreciated that there is a continuing need for a new and improved fingernail protective device which addresses both the problems of ease of use and effectiveness in construction, and in this respect, the present invention substantially fulfills this need.

SUMMARY OF THE INVENTION

In view of the foregoing disadvantages inherent in the known types of fingernail protective devices now present in the prior art, the present invention provides a fingernail protective device wherein the same includes an elongate tubular member for enclosing and effecting protection of a natural fingernail. As such, the general purpose of the present invention, which will be described subsequently in greater detail, is to provide a new and improved fingernail protective device which has all the advantages of the prior art fingernail protective devices and none of the disadvantages.

To attain this, the present invention comprises an elongate tubular fingernail protective device formed of a gelatin porous material. The device may include an elongate enclosed slot for accepting an adhesive therein to enhance the securement of the device to the fingernail, or alternatively utilize a series of parallel apertures for receiving an adhesive therein in a surrounding relationship to the fingernail tubular member. Further, the member may be formed with an open forward end defined as a through-extending aperture arranged orthogonally relative to an axis of the tubular member and may include a "V" shaped slot originating at a rearward end of an upper surface of the tubular member for affording enhanced adjustment and accommodation of a natural fingernail. Finally, an embodiment may include a portion including a forward and rear flap wherein the forward flap may be overfolded relative to the rearward flap about a hinge with apertures formed proximate forward and rear terminal ends of the member for enhanced securement to a fingernail.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved fingernail protective device which has all the advantages of the prior art fingernail protective devices and none of the disadvantages.

It is another object of the present invention to provide a new and improved fingernail protective device which may be easily and efficiently manufactured and marketed.

It is a further object of the present invention to provide a new and improved fingernail protective device which is of a durable and reliable construction.

An even further object of the present invention is to provide a new and improved fingernail protective device which is susceptible to a low cost of manufacture with regard to both materials and labor, and which accordingly is then susceptible of low prices of sale to the consuming public, thereby making such fingernail protective device economically available to the buying public.

Still yet another object of the present invention is to provide a new and improved fingernail protective device which provides in the apparatuses and methods of the prior art some of the advantages thereof, while simultaneously overcoming some of the disadvantages normally associated therewith.

Still another object of the present invention is to provide a new and improved fingernail protective device formed as a tubular member with an interior chamber for effecting protection of a natural fingernail.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 9 is a top orthographic view of a fifth embodiment of the instant invention.

FIG. 10 is an isometric illustration of the embodiment of FIG. 9.

FIG. 11 is an orthographic cross-sectional view of a sixth embodiment of the instant invention.

DESCRIPTION OF THE PREFERRED EMBODIMENT

Figure 1:
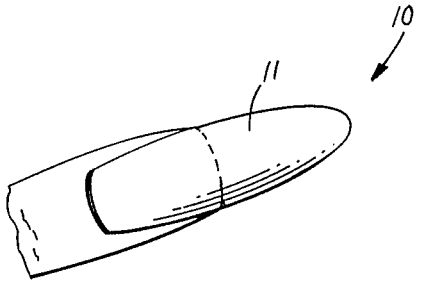
FIG. 1 is a top orthographic view of the instant invention secured to a natural fingernail.

With reference now to the drawings, and in particular to FIGS. 1 to 14 thereof, a new and improved fingernail protective device embodying the principles and concepts of the present invention and generally designated by the reference numeral 10 will be described.

More specifically, the fingernail protective device 10 of the instant invention essentially comprises a tubular member formed of a gelatin porous material to enable absorption of the gelatin of a coating of nail polish or adhesive directed thereon. The tubular members defined with a top surface 11 formed as a convex of a generally elliptical configuration overlying and extending beyond a bottom wall surface 12 defined in the concave wall surface to enclose an associated natural fingernail. An adhesive including nail polish may be applied to secure the device 10 to the associated natural fingernail within a defined chamber 13 formed by the tubular member.

Figure 2:
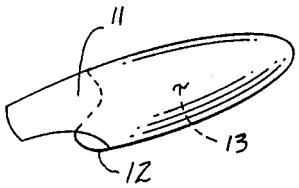
FIG. 2 is an isometric illustration of the instant invention.
Figure 3:
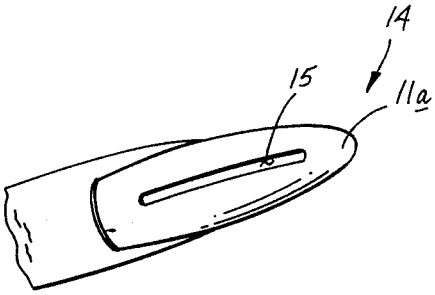
FIG. 3 is a top orthographic view of a second embodiment of the instant invention.
Figure 4:
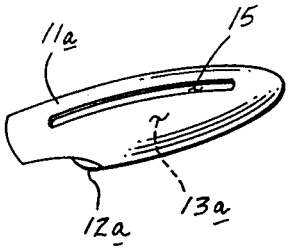
FIG. 4 is an isometric illustration of the embodiment of FIG. 3.

A second embodiment 14, as illustrated in FIGS. 3 and 4, include a top surface 11*a* overlying a bottom surface 12*a* of a configuration comparable to that as set forth in FIGS. 1 and 2, but includes an elongate, enclosed slot 15 aligned coaxially with the protective device 14 to accommodate an adhesive therein to enhance securement of the device 14 to a fingernail received within the chamber 13*a*.

Figure 5:
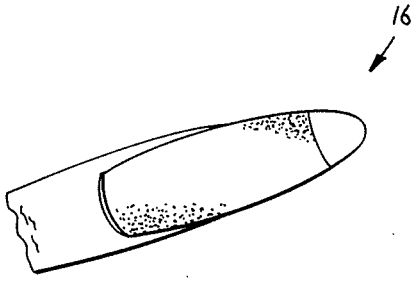
FIG. 5 is a top orthographic view of a third embodiment of the instant invention.
Figure 6:
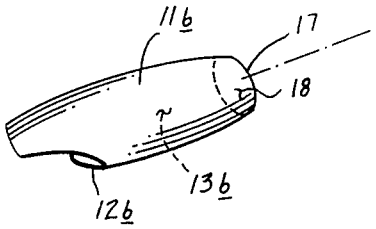
FIG. 6 is an isometric illustration of the embodiment of FIG. 5.

FIGS. 5 and 6 are illustrative of a third embodiment 16 of the fingernail protective device with a top surface 11*b* overlying a bottom surface 12*b* defining an interior chamber 13*b* wherein the third embodiment 16 includes an open front end 17 defining a frontal aperture 18 coaxially aligned with the elongate tubular member defining the protective device 16.

Figure 7:
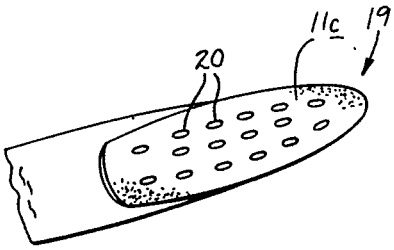
FIG. 7 is a top orthographic view of a fourth embodiment of the instant invention.
Figure 8:
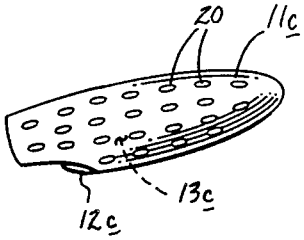
FIG. 8 is an isometric illustration of the embodiment of FIG. 7.
Figure 12:
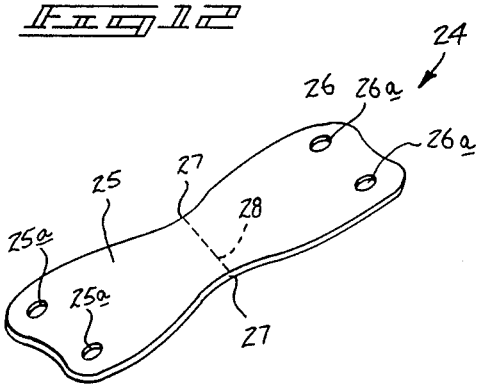
FIG. 12 is an isometric illustration of the sixth embodiment of instant invention.
Figure 13:
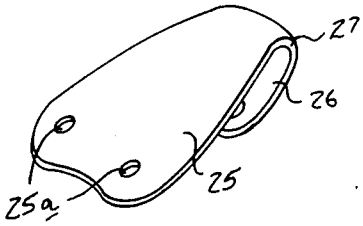
FIG. 13 is an isometric illustration of the sixth embodiment of the instant invention in an overfolded configuration.
Figure 14:
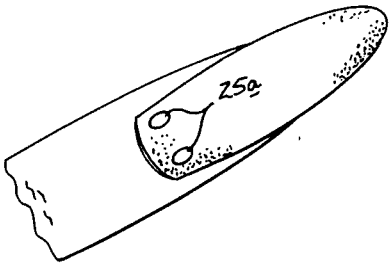
FIG. 14 is a top orthographic view of the sixth embodiment secured to an associated fingernail.

FIGS. 7 and 8 set forth a fourth embodiment 19 of the fingernail protective device wherein plural parallel rows of apertures 20 are arranged through the top and bottom surfaces 11*c* and 12*c* of the device 19 to accommodate an adhesive directed onto the device 19.

FIGS. 9 and 10 illustrate a fifth embodiment 21 of the fingernail protective device wherein an elongate, "V" shaped slot 22 is provided within the top surface 11*d* overlying a bottom surface 12*d* of the device 21 defining a chamber 13*d* therein. The "V" slot originates at a rear terminal end of the top surface 11*d* wherein a forward end of the fifth embodiment 21 terminates in a frontal aperture 23 coaxially aligned with the tubular member defining the fifth embodiment 21.

FIGS. 11 through 14 set forth a sixth embodiment 24 of the fingernail protective device and define a forward flap 25 aligned with a rear flap 26. The edge surfaces joining the forward and rear flaps 25 and 26 respectively include a recess formed at either side thereof to define a hinge 28 therebetween to accommodate an overfolding of the forward flap 25 over the rear flap 26 wherein the forward flap 25 overlies an upper surface of the fingernail with a rear flap 26 overlying a bottom surface of the natural fingernail, as illustrated in FIG. 11 for example. Respective forward and rear apertures 25*a* and 26*a* are positioned adjacent forward and rear ends of the forward and rear flaps 25 and 26 to receive an adhesive therein for enhanced securement of the device to an associated natural fingernail.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A fingernail protective device comprising:

an elongate tubular member defined about a central axis and the tubular member including an upper convex surface with a rear terminal edge overlying and extending beyond an underlying rear terminal edge of a bottom surface, and the tubular member formed of a flexible, porous gelatin to allow breathing of said tubular member and to afford protection to a natural fingernail, said tubular member surroundingly secured to said natural fingernail and said upper convex surface includes a V/shaped slot originating at a rear terminal edge of the upper convex surface said slot provided for enhancing reception of an adhesive, and said tubular member further including a frontal aperture formed through a forward portion of the tubular member said frontal aperture coaxially aligned with the central axis of said tubular member.

* * * * *